United States Patent [19]

Angel

[11] 4,445,524

[45] May 1, 1984

[54] AUTONOMOUS CLEANING INSPECTION DEVICE

[75] Inventor: Thomas M. Angel, Houma, La.

[73] Assignee: Santa Fe International Corporation, Orange, Calif.

[21] Appl. No.: 469,285

[22] Filed: Feb. 24, 1983

[51] Int. Cl.[3] ..... B08B 3/08

[52] U.S. Cl. ..... 134/113; 134/166 C; 405/216; 114/222; 422/6

[58] Field of Search ..... 134/113, 166 C, 167 C; 114/210-229; 405/216; 422/6-10

[56] References Cited

U.S. PATENT DOCUMENTS

| | | | |
|---|---|---|---|
| 660,646 | 10/1900 | Mason | 114/222 |
| 663,180 | 12/1900 | Mason | 114/222 |
| 3,661,506 | 5/1972 | Watkins | 422/6 |
| 3,719,049 | 3/1973 | Shaw et al. | 405/216 |
| 4,273,591 | 6/1981 | Wood et al. | 134/166 C X |

*Primary Examiner*—Robert L. Bleutge

*Attorney, Agent, or Firm*—LeBlanc, Nolan, Shur & Nies

[57] ABSTRACT

A device for removing encrusted marine growth from submerged structures and for Non-Destructive testing of welds and the like is disclosed. The device includes a flexible transparent sleeve or housing for encapsulating an area of the structure to be cleaned and a reservoir for admitting a corrosive chemical into the housing to dissolve the marine growth. The housing may also contain embedded conductors forming a magnetic yoke which, when coupled to a source of electric energy, will subject to area to desired AC and DC fields. Magnetic particle can then be admitted through the reservoir for magnetic particle testing.

10 Claims, 6 Drawing Figures

AUTONOMOUS CLEANING INSPECTION DEVICE

This invention relates to a device for use in Non-Destructive Testing (N.D.T.) of the heat affected zone in welds and the like in submerged structures. The device of this invention functions to remove marine growth such as barnacles quickly and efficiently without scarring the structure or the weld, and subsequently in the administration of a N.D.T. procedure for determining the integrity of the heat affected zone of the weld.

Inspection, repair or modification of submerged structures is complicated by the necessity to initially remove marine growth from the structure to expose the area of interest. Barnacles present a particular problem in that they are salt water shellfish which attach themselves permanently to such submerged objects. The outer shell is formed mostly of calcium carbonate. The removal of this outer shell then by mechanical methods represents a significant time commitment in order to produce an acceptable structural surface for inspection or welding.

Conventional mechanical means might require twenty minutes per running foot to clear a weld test area. In contrast, the device of this invention, as will be subsequently described, will provide a surface cleaned to the metal or concrete structure, itself, within about thirty minutes, or depending on the size of the area, up to two hours. The device of this invention also does not require the continuous presence of a diver as do mechanical scraping procedures.

It has been known for many years that a submerged surface may be cleaned by the application of a chemical liquid within a housing attached to the submerged surface. See for example U.S. Pat. Nos. 660,646 and 663,180. In addition, it has been known that the partially submerged or splashed areas of such structures may be protected from sea water corrosion by providing an inflatable sleeve as described in U.S. Pat. No. 3,719,049. The sleeve may also be inflated, or filled with a corrosion resistant material such as a petroleum based liquid with wetting agents and rust inhibitors as described therein. Also, it is known, as in U.S. Pat. No. 3,661,506, to provide a membrane which serves as a barrier for the area to be protected and which has an inner surface which is absorbent and carries a liquid chemical supplied from an external reservoir. The chemical may be an anti-foulant which is intended to coat the surface while the barrier membrane protects the surface from sea water dilution.

However, the prior art does not contain a multi-purpose portable device which may be rapidly and efficiently used to remove marine growth such as barnacles and to perform a N.D.T. inspection procedure.

The device of this invention includes a sleeve-like housing intended to surround an area to be cleared on a submerged structure to form a chamber with said structure. Peripheral edges of the sleeve mount rubber seals which may be inflatable. The central portion between the peripheral seals is formed of a transparent flexible material. Depending on the configuration of the submerged structural member, the device utilizes one or more spring-loaded hinges to enclose the sleeve about the area to be cleared. The peripheral seal portions also optionally mount electrical conductors to form a magnetic yoke when coupled to a source of electrical energy.

The device further includes an external reservoir for admitting a corrosive chemical to the interior chamber. Because the outer shell of barnacles consists primarily of calcium carbonate, hydrochloric acid or sulfuric acid are ideal for use in dissolving the shells. Obviously, the sleeve member must be formed of a material compatable with said acids. After acid is admitted to the chamber, the dissolution of the barnacle shells will release gas which must exit the chamber. A plurality of one-way valves, formed in the upper portion of the sleeve are provided to vent the chamber.

After the area within the chamber has been cleared, a magnetic particle inspection procedure may be utilized by coupling the magnetic yoke to a source of electrical energy and admitting magnetic particles to the interior of the chamber in the same manner as acid was originally admitted. Particle disposition in the field created across the magnetic yoke may then be observed in the heat affected zone of the weld in question.

In addition, the cleared area is available for other N.D.T. procedures such as X-ray procedures or ultrasonic procedures, as desired.

Accordingly, it is an object of this invention to provide a device which will rapidly and efficiently clear marine growth for non-destructive testing of submerged structures.

Another object of this invention is to provide a device which will facilitate the clearing of barnacles from submerged structures and which then may be further utilized for a non-destructive test inspection of said area.

It is yet another object of this invention to provide an apparatus and procedure which will rapidly and efficiently clear marine growth from a weld area in a submerged structure and which then may be utilized to perform magnetic particle testing without the removal thereof from the structure.

It is still another object of this invention to provide a portable sleeve member which may easily be affixed around an area to be subjected to Non-Destructive testing in a submerged structure and which will contain a corrosive chemical during removal of marine growth thereon to clear the area for further evaluation and testing without the use of substantial mechanical means to remove said growth.

These and other objects will become readily available with reference to the drawings and following description wherein.

Figure 1:
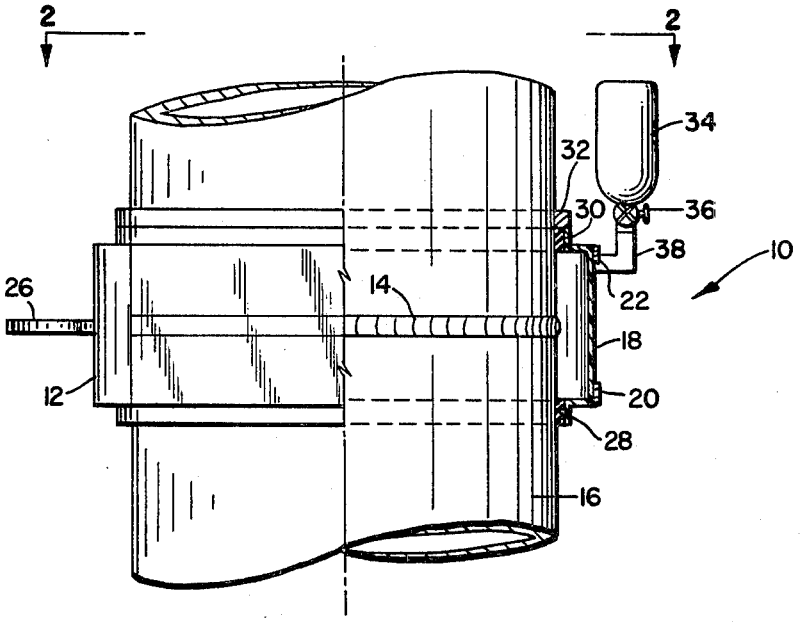
FIG. 1 is a fragmentary view in partial section of an embodiment of the device of this invention affixed to surround a platform leg.
Figure 2:
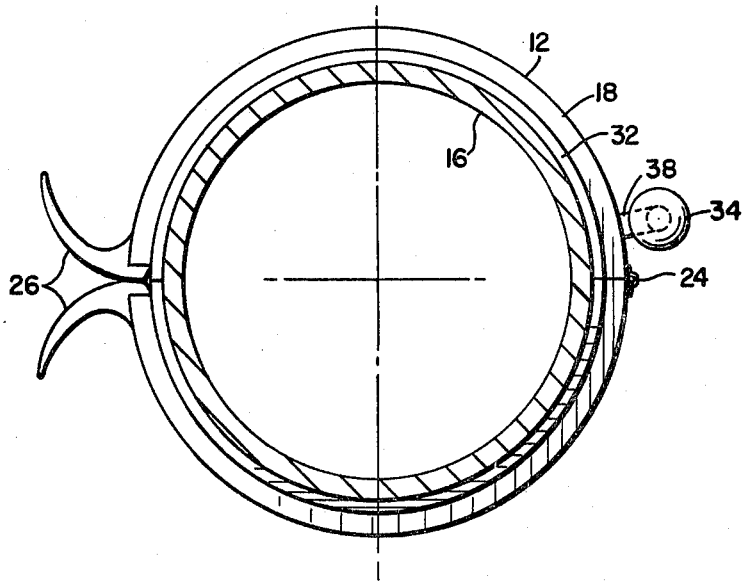
FIG. 2 is a cross-sectional view taken along line 2—2 of FIG. 1.
Figure 3:
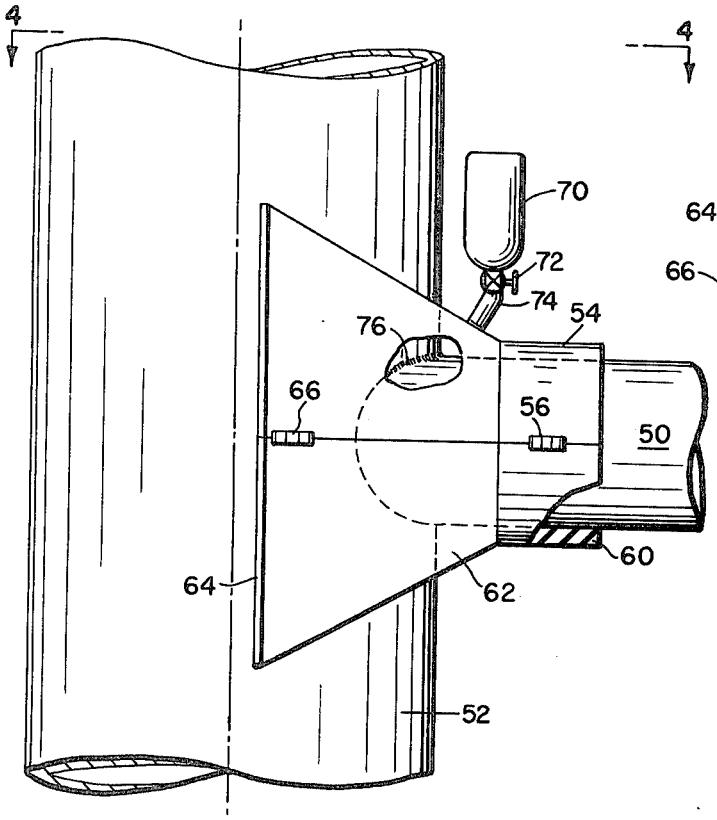
FIG. 3 is a fragmentary view in partial section of another embodiment of this invention affixed to a platform leg and cross-member.
Figure 4:
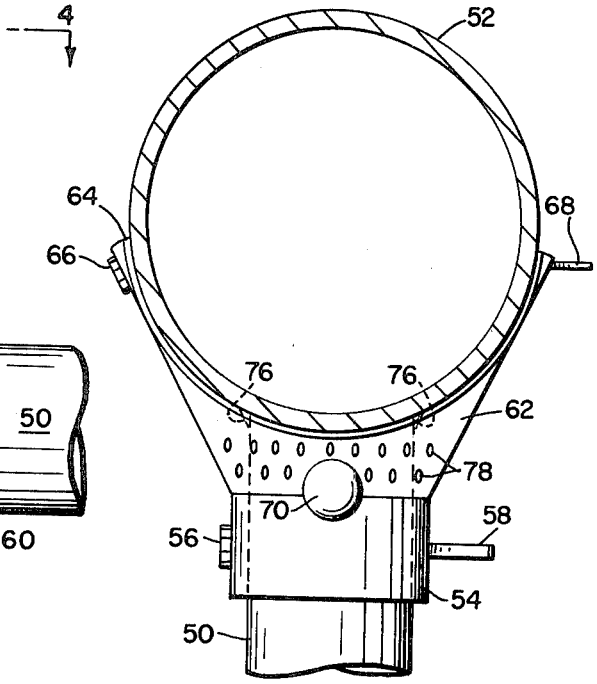
FIG. 4 is a cross-sectional view taken along lines 4—4 of FIG. 3.
Figure 5:
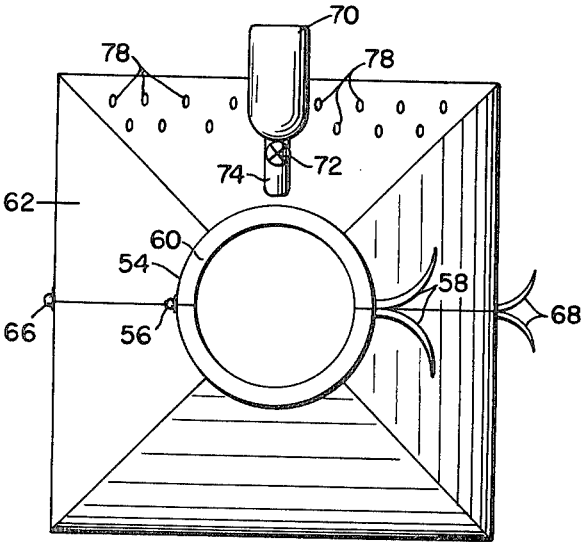
FIG. 5 is a front view of the embodiment of FIG. 3.
Figure 6:
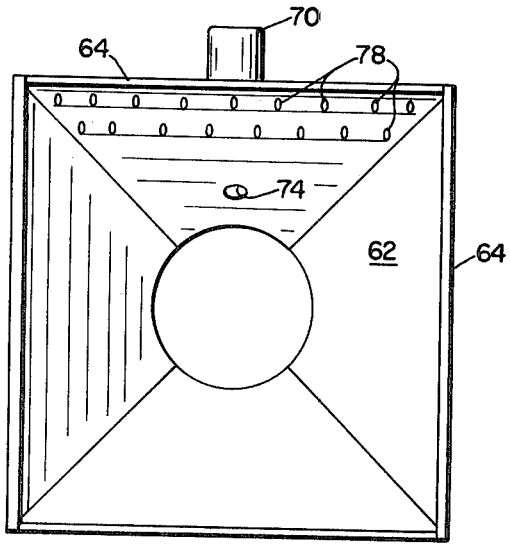
FIG. 6 is a rear view similar to FIG. 5.

With reference to the drawings, and in particular to FIGS. 1 and 2, the device of this invention, 10, consists of a sleeve-like housing, 12, intended to surround or encapsulate a portion of a submerged structure. In FIG. 1, the housing, 12, surrounds a weld, 14, on a platform leg, 16.

The weld, 14, would normally be encrusted with barnacles and similar marine growth. In order to inspect the weld, and in particular the heat affected zone which includes the weld and adjacent metal areas, for cracks and the like, the marine growth and barnacles must be removed. Prior techniques included manual scraping by a diver. Manual procedures are both expensive and time-consuming, in that it would take a diver about 20 minutes per running foot to uncover weld 14 in leg 16. In addition, the manual procedures may result in scarring the weld and adjacent surfaces.

The device of this invention in the embodiment of FIG. 1 is intended to completely surround the weld and heat affected zone of leg 16. Housing, 12, includes a flexible transparent plastic sheath, 18, which is intended to be spaced away from the surface of leg 16 by circumferential upper and lower support members, 20 and 22. The housing, 12, as shown in FIG. 2, operates like a clam shell with opposed hemispheres inter-connected by a spring-loaded hinge, 24. Handles, 26, are provided for opening and closing the housing, 12.

Spacer members, 20 and 22, mount rubber seals, 28 and 30, respectively. The seals, 28 and 30, are intended to minimize the sea water admitted to the interior of housing 12. In addition, spacer member 22 further mounts a magnetic yoke, 32, which surrounds the leg, 16. Yoke 32 consists of embedded circumferentially extending electric wires and is intended to be coupled to a remote source of electrical energy (not shown). Yoke 32, as will be subsequently explained, is intended to be used in a conventional fashion to administer a N. D. T. magnetic particle test inspection procedure.

A reservoir, 34, is mounted on a housing, 12, and includes a valve, 36, and conduit, 38. Reservoir 34 typically contains a corrosive chemical which, when admitted to the interior of housing 12, will dissolve the marine growth encrusting the heat-affected zone surrounding weld 14. In a preferred embodiment of this invention, the corrosive chemical may be either hydrochloric acid or sulphuric acid. It has been found that a 32% solution of hydrochloric acid will quite effectively dissolve barnacle shells within about thirty minutes. Reservoir 34 may be a flexible squeeze bottle, and preferably is transparent.

In operation, the device of this invention, 10, is affixed surrounding the platform leg 16 as shown in FIGS. 1 and 2. The housing, 12, will then form a chamber with the surface of leg 16, surrounding weld 14. When valve 36 is open, admitting acid from reservoir 34 to the interior of the housing 12, the marine growth within the chamber will be dissolved without substantual manual scraping.

Once the marine growth within the housing 12 has been dissolved, any conventional N. D. T. procedure may be utilized.

For example, reservoir 34 may contain magnetic particles in a liquid vehicle. The magnetic yoke, 32, may be coupled to a source of electrical energy and the AC and DC fields desired, created. Magnetic particles may then be admitted to the interior of housing 12 via reservoir 34 and conduit 38. A magnetic particle test inspection then will show by alignment of the particles in the field, where cracks or flaws occur, as is well-known to those skilled in the art.

With reference to the embodiments of FIGS. 3–6, the device of this invention also may be adapted to the weld used to secure a cross-member, 50, to, for example, a submerged portion of a platform leg, 52. In this instance, a sleeve, 54, is intended to surround the cross-member 50. Sleeve 54 consists of two hemispheres interconnected by a spring-loaded hinge, 56, and handle portions of 58 are used to open and close sleeve 54. The interior of sleeve 54 consists of a rubber seal, 60. Extending from sleeve 54 is an apron, 62, preferably of transparent material, which similarly mounts peripheral rubber seals, 64. Apron 62 also consists of two portions inter-connected by a spring-loaded hinge, 66, and is opened and closed by handle members 68.

As in the embodiment of FIGS. 1 and 2, a reservoir 70, is provided with a valve, 72, and conduit, 74, to provide a corrosive chemical or the like to the interior of the chamber formed by apron 62 and the surface of cross-member 50 and leg 52 surrounded thereby. The weld, in this case, 76, is a circumferential weld about cross-member 50. Sleeve 54 may mount a magnetic yoke (not shown) similar to that shown in the embodiment of FIGS. 1 and 2 if desired.

As will be obvious to those skilled in the art, when hydrochloric acid dissolves the outer shell of barnacles, gas will be evolved. Accordingly, a plurality of small holes, 78 are provided in the upper portion of apron 62 to vent the gases.

After the device of this invention has been utilized to clear an area, any conventional N. D. T. procedure may be utilized, including the magnetic particle test described above. In addition, as will be obvious to those skilled in the art, X-ray or ultrasonic tests may also be administered if desired. Following the inspection procedure, the weld area may be coated with a non-hardening petroleum based product such as grease or an anti-foulant or the like to protect the cleaned area from future fouling by marine growth.

The device of this invention then provides an apparatus which will wrap or encapsulate an area to be cleaned in a submerged structure. A corrosive liquid such as an acid may then be utilized effectively. The minimal amount of sea water enclosed within the apparatus of this invention will neutralize a portion of the acid, but because the area is encapsulated, the quantity of acid required will be controlled.

The sleeve or housing of this invention is intended to be constructed from any conventional plastic material which is compatible with the corrosive chemical desired. The contact points between the surface to be cleaned and the housing or sleeve of this invention consists in a preferred embodiment of rubber seals. Obviously a flexible plastic would also be included within the concept of this invention as well as inflatable seals.

This invention is not intended to be limited to the shape of the device described above. The embodiments pictured herein are intended to be illustrative and not limitive of the shape of the housing or spring-loaded clamp member of this invention.

The invention may be embodied in other specific forms without departing from the spirit or essential characteristics thereof. The present embodiment is, therefore, to be considered in all respects as illustrative and not restrictive, the scope of the invention being indicated by the appended claims and all changes which come within the meaning and range of equivalency of the claims are, therefore, intended to be embraced therein.

I claim:

1. A device for removing marine growth from submerged structures prior to the application of non destructive testing inspection procedures comprising:

A flexible transparent housing, means carried by said housing for engaging a predetermined area of a submerged structure to define with the surface of said area a chamber, said means including clamp means for clamping said housing to at least a portion of said structure and seal means carried by said housing for engagement between the periphery thereof and the adjacent surface of said area;

A reservoir carried by said housing and conduit means extending between the reservoir and the housing for selectively admitting liquid from the reservoir to the interior of the housing whereby a corrosive liquid from the reservoir can be admitted to the chamber to dissolve the marine growth.

2. The device of claim 1 wherein the conduit means includes a valve to control the flow of liquid from said reservoir to said housing.

3. The device of claim 1 further comprising vent means carried by said housing for venting gases from within the chamber, formed when the corrosive liquid dissolves the marine growth.

4. The device of claim 1 wherein the clamp means further comprises opposed hemispherical members, said members being hingedly inter connected at an end thereof and bias means mounted on the interconnection normally urging said members together to encircle a portion of a submerged structure.

5. The device of claim 4 further comprising handle means mounted on adjacent ends of said clamp means opposite the hinged connection for opening and closing said clamp means.

6. The device of claim 1 further comprising a magnetic yoke means carried by said housing for creating a magnetic field within the predetermined area for non destructive testing inspection thereof.

7. The device of claim 6 wherein said yoke means includes a plurality of mutually spaced conductors embedded in said housing.

8. The device of claim 7 wherein said reservoir includes a flexible, bottle-shaped container adapted to contain either a corrosive liquid or a suspension of magnetic particles.

9. The device of claim 1 wherein the corrosive liquid is a member selected from the group hydrochloric acid or sulfuric acid.

10. The device of claim 9 wherein the liquid is a 32 percent solution of hydrochloric acid.

* * * * *